US007797759B2

(12) United States Patent
Cunningham

(10) Patent No.: US 7,797,759 B2
(45) Date of Patent: Sep. 21, 2010

(54) KNEEPAD HAVING ADJUSTABLE SIZING PIECES

(75) Inventor: Ian W. Cunningham, Matthews, NC (US)

(73) Assignee: Irwin Industrial Tool Company, Huntersville, NC (US)

( * ) Notice: Subject to any disclaimer, the term of this patent is extended or adjusted under 35 U.S.C. 154(b) by 678 days.

(21) Appl. No.: 10/972,843

(22) Filed: Oct. 25, 2004

(65) Prior Publication Data

US 2005/0120455 A1 Jun. 9, 2005

Related U.S. Application Data

(60) Provisional application No. 60/527,851, filed on Dec. 8, 2003.

(51) Int. Cl.
*A41D 13/00* (2006.01)

(52) U.S. Cl. ..... 2/24

(58) Field of Classification Search ..... 2/16, 2/24, 22, 455, 242, 267, 62, 911; 128/878, 128/881, 882; 602/20, 23, 25–27, 62–63
See application file for complete search history.

(56) References Cited

U.S. PATENT DOCUMENTS

| | | | |
|---|---|---|---|
| 537,607 | A | 4/1895 | Green |
| 833,546 | A | 10/1906 | Pierce |
| 2,122,627 | A | 7/1938 | Sternberg |
| 2,179,903 | A | 11/1939 | Spears |
| 3,383,708 | A | 5/1968 | Pappas |
| 3,463,147 | A | 8/1969 | Stubbs |
| 3,512,776 | A | 5/1970 | Thomas, Sr. |
| D239,220 | S | 3/1976 | Norman |
| 3,942,525 | A | 3/1976 | Dragan |
| 4,013,070 | A | 3/1977 | Harroff |
| 4,243,028 | A | 1/1981 | Puyana |
| 4,334,528 | A | 6/1982 | Gauvry |
| 4,748,975 | A | 6/1988 | Yashima |
| D322,146 | S | 12/1991 | Anderson |
| 5,139,476 | A | 8/1992 | Peters |
| 5,139,477 | A | 8/1992 | Peters |
| 5,226,191 | A | 7/1993 | Mitchell |
| 5,255,391 | A | 10/1993 | Levine |
| D341,005 | S | 11/1993 | Pratt |

(Continued)

OTHER PUBLICATIONS

Irwin Industrial Tool Company, International Patent Application No. PCT/US2004/040276 (filed Dec. 2, 2004), International Search Report and Written Opinion; dated Jan. 4, 2008.

(Continued)

*Primary Examiner*—Tejash Patel
(74) *Attorney, Agent, or Firm*—Dennis J. Williamson; Matthew W. Witsil; Moore & Van Allen PLLC

(57) ABSTRACT

A kneepad comprises a base defining an interior side and a sizing piece attached to the interior side of the base. Moving the sizing piece relative to the base determines the size of a knee that can be accommodated by the kneepad. To accommodate a large knee, the sizing piece may be rotated away from the center of the interior side of the base. To accommodate a small knee, the sizing piece may be rotated towards the center of the interior side of the base.

18 Claims, 4 Drawing Sheets

U.S. PATENT DOCUMENTS

| | | | | | |
|---|---|---|---|---|---|
| D341,679 | S | | 11/1993 | Levine | |
| D347,301 | S | | 5/1994 | Levine | |
| 5,309,570 | A | * | 5/1994 | Grimm | 2/24 |
| 5,417,647 | A | | 5/1995 | Down | |
| 5,450,625 | A | | 9/1995 | Hu | |
| 5,537,689 | A | | 7/1996 | Dancyger | |
| 5,560,041 | A | | 10/1996 | Walker | |
| 5,579,552 | A | * | 12/1996 | Henry | 5/655 |
| 5,594,954 | A | | 1/1997 | Huang | |
| 5,652,956 | A | | 8/1997 | Hoshizaki et al. | |
| D385,670 | S | | 10/1997 | Oetting | |
| 5,711,029 | A | | 1/1998 | Visco et al. | |
| D396,330 | S | | 7/1998 | Oetting | |
| D404,173 | S | | 1/1999 | Popowski | |
| D406,677 | S | | 3/1999 | Koschmann et al. | |
| 5,915,529 | A | | 6/1999 | Popowski | |
| 5,978,962 | A | | 11/1999 | Hamowy | |
| 5,983,408 | A | | 11/1999 | Li | |
| 5,987,643 | A | | 11/1999 | Beutler | |
| 6,029,273 | A | | 2/2000 | McCrane | |
| 6,058,505 | A | | 5/2000 | Bettencourt | |
| 6,101,629 | A | | 8/2000 | Colling | |
| 6,131,195 | A | | 10/2000 | Foreman | |
| 6,151,714 | A | | 11/2000 | Pratt | |
| 6,156,000 | A | | 12/2000 | Chen et al. | |
| 6,205,583 | B1 | | 3/2001 | Beland | |
| 6,253,376 | B1 | | 7/2001 | Ritter | |
| 6,269,485 | B1 | | 8/2001 | Foreman | |
| 6,374,408 | B1 | | 4/2002 | Tomlinson et al. | |
| 6,553,572 | B2 | | 4/2003 | Fiorini et al. | |
| 6,584,616 | B2 | | 7/2003 | Godshaw et al. | |
| 6,623,835 | B2 | | 9/2003 | Chang | |
| 6,687,912 | B2 | * | 2/2004 | Collins et al. | 2/22 |
| 6,795,974 | B1 | * | 9/2004 | Howell | 2/22 |
| 6,832,390 | B1 | * | 12/2004 | Kleinert et al. | 2/22 |
| 6,851,124 | B2 | | 2/2005 | Munoz et al. | |
| 2002/0099314 | A1 | | 7/2002 | Lamping et al. | |
| 2003/0019006 | A1 | | 1/2003 | Godshaw et al. | |

OTHER PUBLICATIONS

Irwin Industrial Tool Company, International Patent Application No. PCT/US2004/040276 (filed Dec. 2, 2004), International Preliminary Report on Patentability; dated Mar. 12, 2009.

* cited by examiner

KNEEPAD HAVING ADJUSTABLE SIZING PIECES

RELATED APPLICATIONS

The present patent document claims the benefit of the filing date under 35 U.S.C. §119(e) of Provisional U.S. Patent Application Ser. No. 60/527,851, filed Dec. 8, 2003, the entire contents of which is hereby incorporated by reference.

BACKGROUND

Historically, to prevent knee injuries during physical activity that requires being in a kneeling position, a user would wear a protective kneepad over the front of their knee. Traditional protective kneepads normally include some type of rigid cap secured against the front of a knee by some type of strap that surrounds the knee and leg of the user.

These traditional protective kneepads, however, suffer from a number of deficiencies. For example, typical kneepads only come in one size or a limited number of sizes. Furthermore, as the size of any one kneepad is typically static and not adjustable, the same kneepad cannot be used comfortably by different users with different sized knees. Therefore, the protective portion of the kneepad often does not securely fit against the knee of a user and tends to rotate about the knee or move off of the front of the knee. This movement can cause irritation to the leg and knee of the user due to rubbing. It can also cause problems when the protective area of the kneepad no longer protects the knee of the user, thereby defeating the purpose of the kneepad.

BRIEF SUMMARY

It is therefore desirable to have a kneepad that is adjustable to fit the knee of a specific user so that the kneepad will remain stationary over the front of the knee during use. The present invention is directed at correcting these deficiencies in the prior art.

In one aspect of the invention, a kneepad includes a base defining an interior side and a sizing piece attached to the interior side of the base. Moving the sizing piece relative to the base determines the size of a knee that can be accommodated by the kneepad. To accommodate a large knee, the sizing pieces may be rotated away from the center of the interior side of the base. To accommodate a small knee, the sizing pieces may be rotated towards the center of the interior side of the base.

DETAILED DESCRIPTION OF THE PRESENTLY PREFERRED EMBODIMENTS

Figure 1:
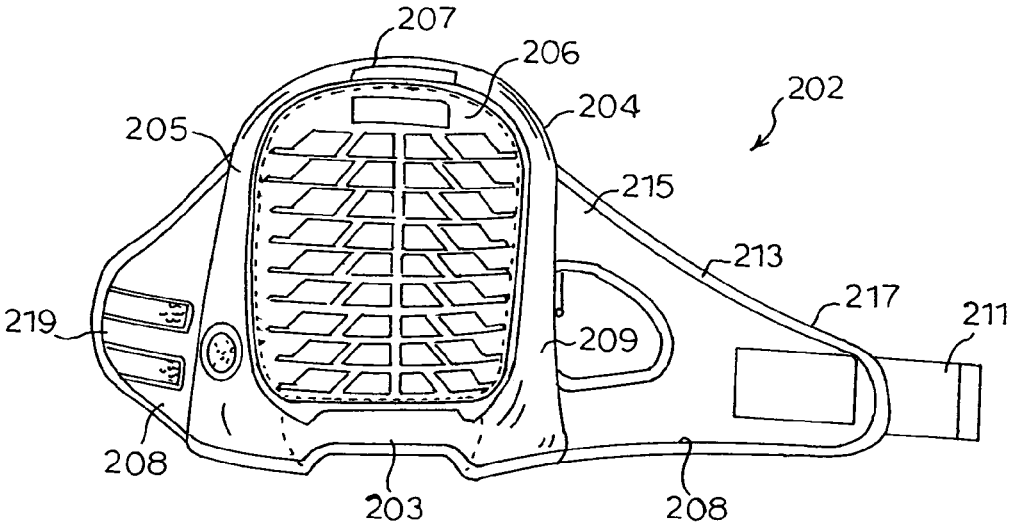
FIG. 1 is a planar front view of a first embodiment of a kneepad having a set of sizing pieces in accordance with the present invention.

As shown in FIG. 1, a kneepad 202 to protect a knee of a user generally includes a flexible base 204, a rigid cap 206, and a strap assembly 208. Preferably, the flexible base 104 is made of a padded fabric with an elastomeric or silicone interior.

The rigid cap 206 is preferably a rigid plastic such as PVC, but any rigid material can be used. In one embodiment, the rigid cap 206 may be attached to the flexible base 204 by any way known in the art such as sewing the rigid cap 206 to the flexible base 204 or gluing the rigid cap 206 to the flexible base 204. In other embodiments, the rigid cap 206 may be removably attached to the flexible base 204 by any way known in the art, such that different sized rigid caps 206 or rigid caps 206 made of different materials could be used with the same kneepad 202.

The flexible base 204 has a lower portion 203, a left portion 205, an upper portion 207, and a right portion 209. Preferably, the rigid cap 206 is positioned in the center of the flexible base 204 such that the rigid cap 206 is positioned directly over the front of the user's knee, but the rigid cap 206 may also be positioned offset from the center of the flexible base 204, towards the lower portion 203, left portion 205, upper portion 207, or right portion 209 of the flexible base 204.

In general, a user places the flexible base 204 containing the rigid cap 206 over the knee such that the rigid cap 206 covers the front of the knee. Once the flexible base 104 and the rigid cap 206 are in a desired position, the user secures the kneepad 202 to the knee using the strap assembly 208 around the leg.

Preferably, the strap assembly 208 generally includes an elongated strap 213 having a first portion 215 permanently attached to the flexible base 204. A second portion 217 of the elongated strap 213 preferably includes a surface of minute hooks 211 that contacts a surface of uncut pile 219 to secure the kneepad 202 when the elongated strap 213 is wrapped around a leg of a user. In other embodiments, any type of strap assembly 208 known in the art could be used to secure the kneepad 202.

Figure 2A:
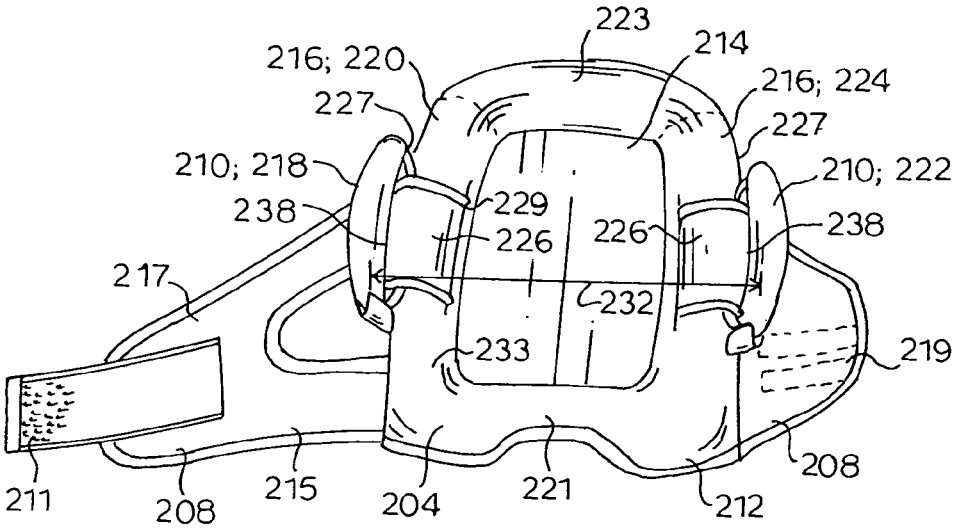
FIG. 2A is a planar back view of the kneepad of FIG. 1 showing the sizing pieces rotated outward.
Figure 2B:
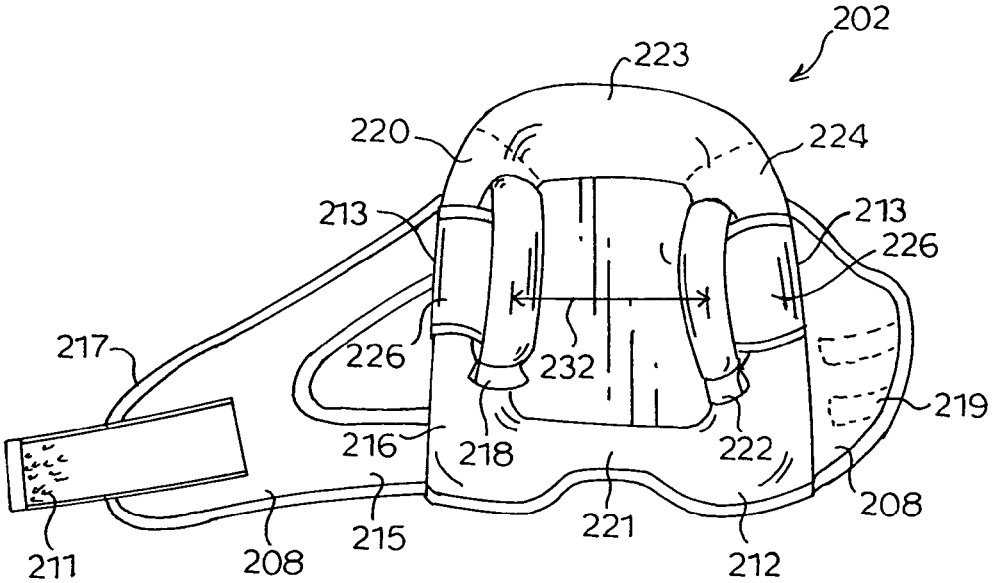
FIG. 2B is a planar back view of the kneepad of FIG. 1 showing the sizing pieces rotated inward.

As seen in FIGS. 2A and 2B, in one embodiment, the kneepad 202 includes at least one sizing piece 210 to adjust the fit of the kneepad 202 to comfortably accommodate different sized knees. Preferably, an interior side 212 of the kneepad 202, which faces the front of the knee of the user during use, defines a concave region 214. The sizing pieces 210 are preferably located on one or both of side walls 216 of the concave region 214, but the sizing pieces 210 may be placed on a bottom wall 221, top wall 223, or anywhere on the interior side 212 of the kneepad 202.

In one preferred embodiment, the kneepad 202 includes two sizing pieces 210, but any number of sizing pieces 210 could be used. Preferably, a first sizing piece 218 is located on a first interior wall 220 of the concave region 214 and a second sizing piece 222 is located on a second interior wall 224 opposite the first sizing piece 218. Other embodiments may include a third or fourth sizing piece 210 located on the bottom wall 221 or the top wall 223 of the concave region 214.

Figure 3A:
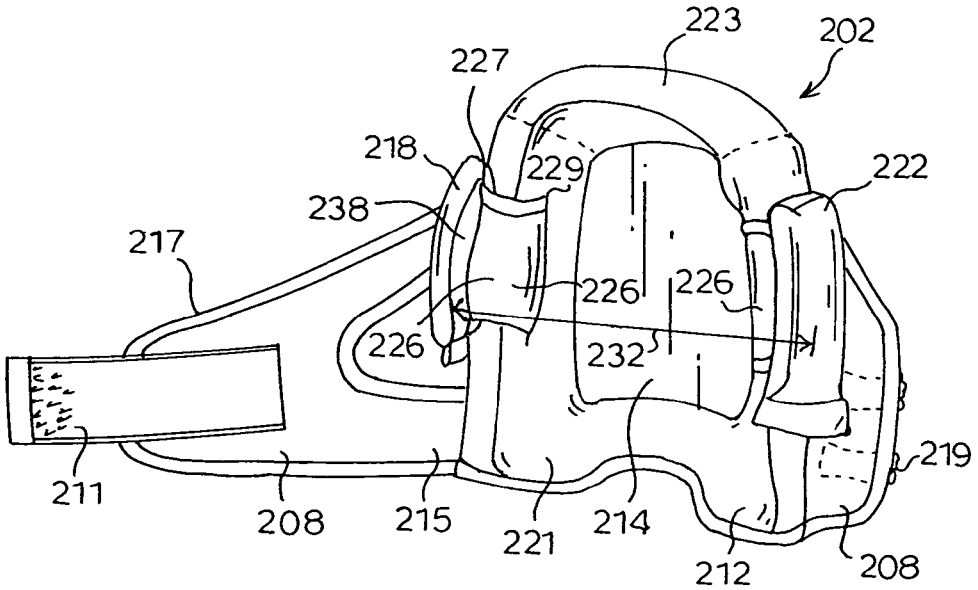
FIG. 3A is a perspective back view of the kneepad of FIG. 1 showing the sizing pieces rotated outward.
Figure 3B:
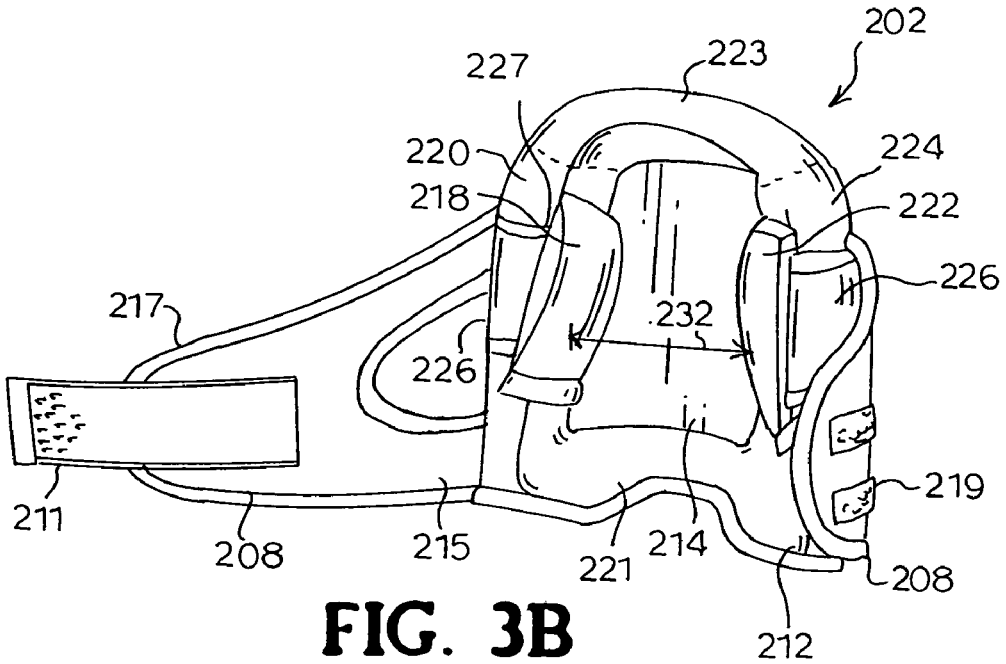
FIG. 3B is a perspective back view of the kneepad of FIG. 1 showing the sizing pieces rotated inward.

Preferably, the first and second sizing pieces 218, 222 are attached to the kneepad 202 such that the first and second sizing pieces 218, 222 may rotate about the first and second interior walls 220, 224 of the concave region 214. Typically each sizing piece 218, 222 may rotate about the interior walls 220, 224 away from the center of the concave region 214 to a first position as seen in FIGS. 2A and 3A, or rotate towards the center of the concave region 214 to a second position as seen in FIGS. 2B and 3B.

In a first embodiment shown in FIGS. 1-3, each of the sizing pieces 218, 222 is rotatably attached to the kneepad 202 to rotate about the first or second interior walls 220, 224 by slidably attaching each sizing piece 218, 222 to a separate strap 226, each of which partially surrounds one of the side walls 216 of the concave region 214. Typically, a first end 229 of the strap 226 is attached to the flexible base 204 on a first side 233 of the side wall 216 of the concave region 214 and a second end 238 of the strap 226 is attached to the flexible base 204 on a second side of the side wall 216 of the concave region 214.

Each sizing piece 218, 222 typically includes a loop 227 on an interior side 238 of the sizing piece 218, 222. The strap 226 passes through the loop 227 to allow the strap 226 to guide the movement of the sizing piece 218, 222 such that the sizing piece 218, 222 may be slidably attached to the strap 226 and rotate towards the center of the concave region 214 or away from the center of the concave region 214.

A kneepad could utilize friction, a hoop and look fastener, or any other type of system known in the art to hold the sizing piece 218, 222 in a desired position along the side wall 216 of the concave region 214.

In some embodiments, the loop 227 may detach from the interior side 238 of the sizing piece 218, 222 so that the sizing piece 218, 222 can be removed from the strap 226 and replaced. Therefore, different sized and shaped sizing pieces 218, 222 may be available with various degrees of padding to accommodate user preference.

Figure 4:
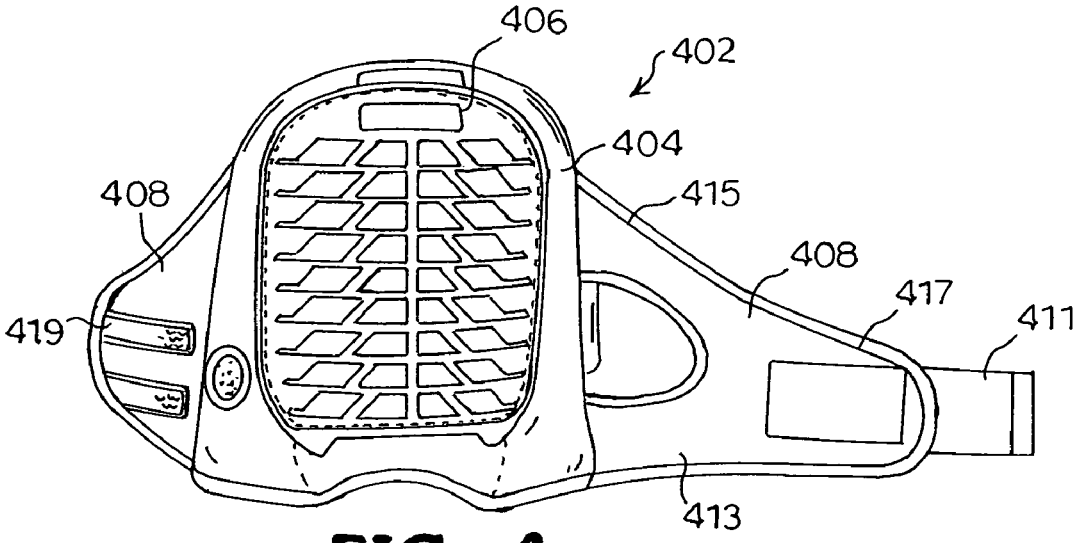
FIG. 4 is a planar front view of a second embodiment of a kneepad having a set of sizing pieces in accordance with the present invention.
Figure 5:
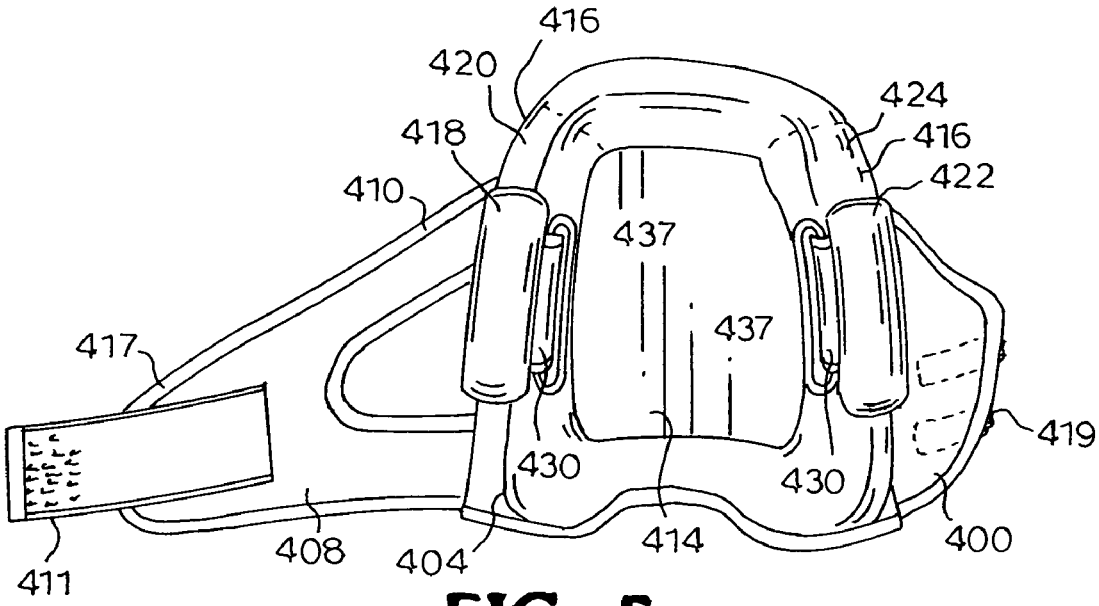
FIG. 5 is a planar back view of the kneepad of FIG. 4.

In a second embodiment shown in FIGS. 4 and 5, the sizing pieces 418, 422 are rotatably attached to the first and second interior walls 420, 424 by attaching each sizing piece 418, 422 to a circular piece of elastomeric material 430. The circular piece of elastomeric material 430 surrounds one of the side walls 416 and passes through an opening 437 below the side wall 416 on the flexible base 404 such that the elastomeric material may rotate around the side wall 416 of the concave region 414.

During use, rotating a sizing piece 418, 422 away from or towards the center of the concave region 414 is achieved by rotating the piece of elastomeric material 430 around the side wall 416, thereby rotating the sizing piece 418, 422. To hold the sizing piece 418, 422 in a desired position along the side wall 416 of the concave region 414, a kneepad could utilize friction, a hoop and look fastener, or any other type of system known in the art.

In some embodiments, the piece of elastomeric material 430 may be detachable from the kneepad 402 for convenient replacement. In this embodiment, the piece of elastomeric material typically comprises a detachment section comprising a hook and loop fastener, a snap, a buckle, or any other way known in the art that allows the loop to be broken into a strap. To detach the piece of elastomeric material 430 from the kneepad 402, the detachment section is broken resulting in an open strap that is removable from the kneepad 402. Therefore, through the use of the removable piece of elastomeric material 430, different sized and shaped sizing pieces 418, 422 may be available with various degrees of padding to accommodate user preference.

In additional embodiments, the sizing pieces 218, 222 could alternatively be loosely held by a hook and loop fastener to the side walls 216 of the concave region 214. In this embodiment, each sizing piece 218, 222 includes a surface of minute hooks on the interior side 238 of the sizing piece 218, 222 while each side wall 216 includes a surface of uncut pile that engages the hooks as is well known. Alternatively, any other type of fastening system known in the art could be used that is capable of holding the sizing piece 218, 222 stationary against either side wall 216, the bottom wall 221, or the top wall 223.

Figure 6:
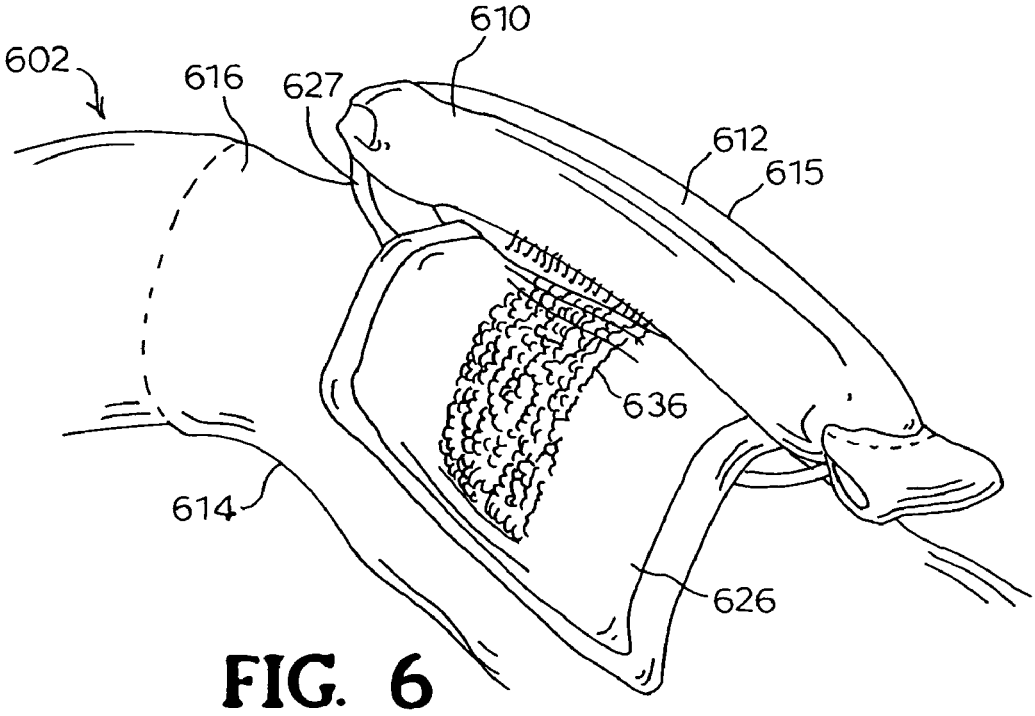
FIG. 6 is a perspective view of one embodiment of a sizing piece to be used with the kneepads of FIGS. 1-5.

The sizing pieces 218, 222 generally serve to brace the kneepad 202 against the front of the knee of the user, especially at the kneecap. One embodiment of a sizing piece 610 is shown in FIG. 6. The sizing piece of FIG. 6 is generally used with the kneepad embodiment of FIGS. 1-3.

The sizing piece 610 is preferably in the shape of a block, but the sizing piece 610 could be any shape. Additionally, the sizing piece 610 is preferably made of an elastomeric material, but the sizing piece 610 could be made of any material known in the art that does not cause discomfort to a user during use of the kneepad 202 (FIG. 2).

The sizing piece 610 preferably includes at least one padded section 612 located on an outer portion 615 of the sizing piece 610. The at least one padded section 612 is the portion of the sizing piece 610 that contacts the knee of the user. In some embodiments, the sizing piece 610 may include a loop 627 that surrounds one of the straps 626 surrounding one of the side walls 616 of the concave region 614 of the kneepad 602. Additionally, the sizing piece 610 may also include a portion of a hook and loop fastener 636 on the interior portion of the sizing piece 610 to secure the sizing piece 610 to one of the straps 626.

Operation of the invention can be understood with respect to FIGS. 1-3, wherein rotating the first sizing piece 218 or the second sizing piece 222 towards or away from the center of the concave region 214 changes a distance 232 between the sizing pieces 218, 222. Rotating the sizing pieces 218, 222 away from the center of the concave region 214, and even out of the concave region 214, as shown in FIGS. 2A and 3A, creates the largest distance 232 between the sizing pieces 218, 222. Rotating the sizing pieces 218, 222 towards the center of the concave region 214, as shown in FIGS. 2B and 3B, creates the smallest distance 232 between the sizing pieces 218, 222.

Due to the fact that the concave region surrounds the front of the knee including the kneecap, changing the distance 232 between the first and second sizing pieces 218, 222 allows the kneepad 202 to comfortably accommodate different sized knees for different users and prevent the kneepad 202 from slipping or rotating about the knee during use.

To accommodate a small knee, both sizing pieces 218, 222 should be rotated towards the center of the concave region 214 to decrease the distance 232 between the sizing pieces 218, 222 until the first sizing piece 218 comfortably contacts a first side of the kneecap while the second sizing piece 222 comfortably contacts a second side of the kneecap. Alternatively, to accommodate a large knee, both sizing pieces 218, 222 should be rotated away from the center of the concave region 214, or even out of the concave region 214, to increase the distance 232 between the sizing pieces 218, 222 until the first sizing piece 218 comfortably contacts the first side of the kneecap while the second sizing piece 228 comfortably contacts the second side of the kneecap.

The same procedure described above is used to adjust the sizing pieces in the embodiment of FIGS. 4-5. Rotating the first and second sizing pieces 418, 422 towards or away from the center of the concave region 414 allows the kneepad 402 to comfortably accommodate different sized knees. To accommodate a small knee, the first and second sizing pieces 418, 422 are rotated towards the center of the concave region 414. To accommodate a large knee, the first and second sizing pieces 418, 422 are rotated away from the center of the concave region 414.

It is therefore intended that the foregoing detailed description be regarded as illustrative rather than limiting, and that it be understood that it is the following claims, including all equivalents, that are intended to define the spirit and scope of this invention.

I claim:

1. A kneepad comprising:

a base defining a concave region on an interior side of said base for receiving a knee and a rigid cap attached to an exterior side of said base;

a strap at least partially surrounding an interior wall of said concave region, and being attached at each end to said interior wall, proximate to the limits of said interior wall, or at the limits of said interior wall; and an at least partially padded sizing piece movable between a first position and a second position, when in the first position the size, shape and position of said sizing piece modify said concave region to have a first dimension for receiving a first size knee and when in said second position the size, shape and position of said sizing piece modify said concave region to have a second dimension for receiving a second size knee, said sizing piece occupying either the first position or the second position when the base is secured to the knee.

2. The kneepad of claim 1, wherein said strap is movable between at least two positions.

3. A method for adjusting the fit of a kneepad comprising:

providing a kneepad comprising:

a base defining a concave region on an interior side of said base; and a sizing piece attachable to the interior side of said base, said sizing piece comprising a padded block;

adjusting said kneepad to accommodate a first knee size by moving said sizing piece to either a first position or a second position, when in said first position said sizing piece size, shape, and position defining the concave region to have a first dimension for receiving a first size knee and when in said second position said sizing piece size, shape, and position defining the concave region to have a second dimension for receiving a second size knee; and adjusting said kneepad to accommodate a second knee size by rotating said sizing piece at least partially into said concave region.

4. The method of claim 3:

wherein said kneepad further comprises a second sizing piece attachable to said interior side of said base; and further wherein the step of adjusting said kneepad to accommodate said first knee further comprises rotating said second sizing piece out of said concave region to increase the area of said knee to be received within said concave region; and further wherein the step of adjusting said kneepad to accommodate said second knee further comprises rotating said second sizing piece at least partially into said concave region.

5. The method of claim 3, further comprising the step of securing said kneepad in position on said knee of said user using a strap assembly.

6. A kneepad comprising:

a base defining an interior side and a rigid cap attached to said base, said base defining a concave region on said interior side, said concave region having a first interior wall and a second interior wall opposite said first interior wall;

an at least partially padded first sizing piece and an at least partially padded second sizing piece, wherein moving said first sizing piece or said second sizing piece relative to said base determines the size of a knee that can be accommodated by said kneepad, said first sizing piece slidably attached to a first sizing strap that is attached at each end to said first interior wall, proximate to the limits of said first interior wall, or at the limits of said first interior wall, and said second sizing piece slidably attached to a second sizing strap that is attached at each end to said second interior wall, proximate to the limits of said second interior wall, or at the limits of said second interior wall; and a strap connected to said base to secure said base and said rigid cap to a leg of said user in position over said knee.

7. The kneepad of claim 6 wherein said strap is frictionally held stationary against said first interior wall.

8. The kneepad of claim 6 wherein a hook and loop fastener holds said strap stationary against said first interior wall.

9. The kneepad of claim 6 wherein said strap and said sizing piece are detachable from said kneepad.

10. A kneepad comprising:

a base defining an interior side and a rigid cap attached to said base, said base defining a concave region on said interior side, said concave region having a first interior wall and a second interior wall opposite said first interior wall;

an at least partially padded sizing piece attachable to said first interior wall, wherein moving said sizing piece relative to said base determines the size of a knee that can be accommodated by said kneepad; and a first strap connected to said base to secure said base and said rigid cap to a leg of said user in position over said knee;

wherein said sizing piece is attached to said base by a second strap such that said sizing piece slides over said second strap around said first interior wall.

11. The kneepad of claim 10, wherein said sizing piece attaches to said first interior wall using a hook and loop fastener.

12. The kneepad of claim 10, wherein said second strap is constructed from an elastomeric material.

13. The kneepad of claim 10, wherein said sizing piece is frictionally held stationary against said first interior wall.

14. The kneepad of claim 10, wherein a hook and loop fastener holds said first sizing piece stationary against said first interior wall.

15. The kneepad of claim 10, wherein said sizing piece is detachable from said second strap.

16. A kneepad comprising:

a base defining a concave region on an interior side of said base for receiving a knee;

a first strap at least partially surrounding a first interior wall of said concave region;

a second strap at least partially surrounding a second interior wall of said concave region opposite said first wall; and a first at least partially padded sizing piece movably attached to said first strap and a second sizing piece movably attached to said second strap, said first sizing piece and said second sizing piece movable between a first position and a second position, when said second sizing piece is in the first position and said first sizing piece is in the first position the size, shape, and position of said first sizing piece modify said concave region to have a first dimension for receiving a first size knee and when said first sizing piece is in said second position the size, shape, and position of said first sizing piece modify said concave region to have a second dimension for receiving a second size knee, and when said second sizing piece is in the second position and said first sizing piece is in the first position the size, shape, and position of said first sizing piece modify said concave region to have a third dimension for receiving a third size knee.

17. The kneepad of claim 16, wherein said sizing piece is held stationary against said interior wall in said first position.

18. The kneepad of claim 16, wherein a first hook and loop fastener holds said sizing piece stationary against said interior wall.

* * * * *